US010152926B2

(12) United States Patent
Ishikawa

(10) Patent No.: US 10,152,926 B2
(45) Date of Patent: Dec. 11, 2018

(54) DRIVING CIRCUIT FOR LIGHT EMITTING ELEMENT, LIGHT EMITTING DEVICE USING SAME, AND DISPLAY APPARATUS

(75) Inventor: Hiroyuki Ishikawa, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 533 days.

(21) Appl. No.: 13/580,857

(22) PCT Filed: Feb. 24, 2011

(86) PCT No.: PCT/JP2011/001057

§ 371 (c)(1),
(2), (4) Date: Oct. 31, 2012

(87) PCT Pub. No.: WO2011/105086

PCT Pub. Date: Sep. 1, 2011

(65) Prior Publication Data

US 2013/0038819 A1 Feb. 14, 2013

(30) Foreign Application Priority Data

Feb. 26, 2010 (JP) ..... 2010-041423

(51) Int. Cl.
*F25B 21/04* (2006.01)
*G09G 3/34* (2006.01)
*H05B 33/08* (2006.01)

(52) U.S. Cl.
CPC ..... *G09G 3/342* (2013.01); *H05B 33/0815* (2013.01); *H05B 33/0827* (2013.01);
(Continued)

(58) Field of Classification Search
CPC ..... G09G 3/30; G09G 3/32; G09G 3/3208; G09G 3/3275; G09G 3/3283
(Continued)

(56) References Cited

U.S. PATENT DOCUMENTS 5,896,120 A * 4/1999 Iguchi ..... G06F 3/041 345/102
8,111,006 B2 * 2/2012 Komiya ..... G09G 3/14 315/291

(Continued)

FOREIGN PATENT DOCUMENTS

JP 2005-33853 A 2/2005
JP 2005033853 A * 2/2005

(Continued)

OTHER PUBLICATIONS

International Preliminary Report on Patentability for International Application No. PCT/JP2011/001057, dated Sep. 18, 2012, with English translation.

(Continued)

*Primary Examiner* — Ifedayo Iluyomade
(74) *Attorney, Agent, or Firm* — Cantor Colburn LLP

(57) ABSTRACT

LED terminals are respectively provided to light emitting units, and are each connected to the second terminal of the corresponding one of the light emitting units. Current sources are respectively provided to the LED terminals, and are respectively configured to supply adjustable driving currents to the respective light emitting units via the respective LED terminals. A reference voltage source generates a reference voltage that corresponds to the driving current. A control circuit controls a DC/DC converter such that the lowest voltage from among voltages at the LED terminals matches the reference voltage.

12 Claims, 4 Drawing Sheets

(52) U.S. Cl.
CPC . *G09G 2320/064* (2013.01); *G09G 2330/021* (2013.01); *G09G 2330/045* (2013.01)

(58) Field of Classification Search
USPC ..... 345/204, 690, 211, 76–83, 100
See application file for complete search history.

(56) References Cited

U.S. PATENT DOCUMENTS

| | | | | |
|---|---|---|---|---|
| 2005/0190128 | A1* | 9/2005 | Hayafuji | G09G 3/3266 345/76 |
| 2006/0176253 | A1* | 8/2006 | Yazawa | G09G 3/3216 345/82 |
| 2007/0285031 | A1* | 12/2007 | Shteynberg | H02M 3/157 315/294 |
| 2008/0111800 | A1* | 5/2008 | Wang | G09G 3/3406 345/204 |
| 2009/0196138 | A1* | 8/2009 | Kaji | G11B 7/00456 369/59.11 |
| 2009/0201231 | A1* | 8/2009 | Takahara | G09G 3/3233 345/76 |
| 2010/0002018 | A1* | 1/2010 | Hirata | G09G 5/028 345/690 |
| 2010/0039421 | A1* | 2/2010 | Toyomura | G09G 3/3233 345/212 |
| 2010/0149458 | A1* | 6/2010 | Nam | H05B 41/282 349/70 |
| 2010/0194294 | A1* | 8/2010 | Kitagawa | H05B 33/0827 315/161 |
| 2011/0128303 | A1* | 6/2011 | Yonemaru | H05B 33/0827 345/690 |

FOREIGN PATENT DOCUMENTS

| | | | |
|---|---|---|---|
| JP | 3755770 | B2 | 1/2006 |
| JP | 2007005450 | A | 1/2007 |
| JP | 2007-220928 | A | 8/2007 |
| JP | 2007-242886 | A | 9/2007 |
| JP | 2008-60253 | A | 3/2008 |
| JP | 2008227325 | A | 9/2008 |
| JP | 2009-49270 | A | 3/2009 |
| JP | 2010011608 | A | 1/2010 |
| JP | 2010015879 | A | 1/2010 |
| WO | 2009119066 | A1 | 10/2009 |

OTHER PUBLICATIONS

International Search Report for International Application No. PCT/JP2011/001057, dated Apr. 19, 2011, with English translation.
Japanese Notification of Reason(s) for Refusal corresponding to Patent Application No. 2012-501682; dated Dec. 16, 2014, with English translation.
Japanese Notification of Reasons for Refusal corresponding to Patent Application No. 2015-210080; dated Jul. 19, 2016, with English translation.
Notification of Reasons for Refusal for corresponding JP Application No. 2017-140595; dated Apr. 17, 2018.
JPO Notification of Reasons for Refusal corresponding to JP Application No. 2017-140595; dated Sep. 11, 2018.

* cited by examiner

DRIVING CIRCUIT FOR LIGHT EMITTING ELEMENT, LIGHT EMITTING DEVICE USING SAME, AND DISPLAY APPARATUS

CROSS REFERENCE TO RELATED APPLICATIONS

This is a U.S. national stage of application No. PCT/JP2011/001057, filed on 24 Feb. 2011. Priority under U.S.C. § 119(a) and 35 U.S.C. § 365(b) is claimed from Japanese Application No. 2010-041423, filed 26 Feb. 2010, the disclosure of which are also incorporated herein by reference.

BACKGROUND OF THE INVENTION

1. Field of the Invention

The present invention relates to a driving circuit for a light emitting element.

2. Description of the Related Art

A light emitting diode (LED) is employed as a backlight for a liquid crystal panel, a light source configured as an incoming indicator for a cellular phone terminal, or otherwise an illumination device configured as an alternative to a fluorescent bulb. In order to control such an LED to emit light with a desired luminance, there is a need to configure a driving circuit to control a DC/DC converter so as to supply to the LED a sufficient driving voltage and a driving current that corresponds to the luminance.

Patent document 1 discloses a circuit configured to drive an LED with high efficiency. With such a technique disclosed in Patent document 1, an LED string and a constant current source are connected in series between an output terminal of a DC/DC converter and a fixed voltage terminal. With such an arrangement, the constant current source is configured as a variable current source which can adjust its current. Furthermore, the DC/DC converter is configured to control its output voltage such that a detection voltage Vdet which is a voltage drop that occurs at the constant current source matches a predetermined reference voltage Vref.

RELATED ART DOCUMENTS

Patent Documents

[Patent Document 1]

Japanese Patent Application No. 3755770

Accompanying the increased demand for energy saving, there is an increased demand for a driving circuit to operate with further reduced power consumption.

SUMMARY OF THE INVENTION

The present invention has been made in view of such a situation. Accordingly, it is an exemplary purpose of an embodiment of the present invention to provide a driving circuit which is capable of driving a light emitting element with high efficiency.

An embodiment of the present invention relates to a driving circuit configured to control a DC/DC converter configured to generate a driving voltage to be applied to a first terminal to which at least one light emitting units are commonly connected, and to supply a driving current to each of the at least one light emitting units. The driving circuit comprises: at least one driving terminals respectively provided to the at least one light emitting units, each configured to be connected to a second terminal of the corresponding light emitting unit; at least one current sources respectively provided to the at least one driving terminals, each configured to supply the adjustable driving current to the corresponding light emitting unit via the corresponding driving terminal; a reference voltage source configured to generate a reference voltage having a voltage level that corresponds to the driving current; and a control circuit configured to control the DC/DC converter such that a lowest voltage from among voltages at the at least one driving terminals matches the reference voltage.

In a case in which the driving current value generated by the current source changes, by changing the reference voltage according to the driving current, such an arrangement is capable of reducing voltage drop that occurs at the current source, i.e., reducing power consumption, as compared with an arrangement in which the reference voltage is set to a fixed value. Thus, such an arrangement is capable of driving the light emitting element with high efficiency.

Also, the at least one light emitting units may be each configured to generate a driving current that corresponds to a common first voltage. Also, the reference voltage source may be configured to generate the reference voltage according to the first voltage.

With such an arrangement, the driving current and the reference voltage can be changed according to the first voltage.

Also, the reference voltage source may be configured to generate a reference voltage that is changed in a stepwise manner according to the driving voltage. Also, the reference voltage source may be configured to generate a reference voltage that is substantially proportional to the driving voltage.

Also, the at least one light emitting units may be each configured to generate the driving current that corresponds to a common first voltage which indicates a target value of the driving current. Also, the reference voltage source may be configured to generate the reference voltage according to the driving current generated by the aforementioned at least one light emitting units.

Also, the reference voltage source may be configured to generate a reference voltage that changes in a stepwise manner according to the driving current generated by the light emitting unit. Also, the reference voltage source may be configured to generate a reference voltage that is substantially proportional to the driving current generated by the light emitting unit.

Another embodiment of the present invention also relates to a driving circuit configured to control a DC/DC converter configured to generate a driving voltage to be applied to a first terminal to which at least one light emitting units are commonly connected, and to supply a driving current to each of the at least one light emitting units. The driving circuit comprises: at least one driving terminals respectively provided to the at least one light emitting units, each configured to be connected to a second terminal of the corresponding light emitting unit; at least one current sources respectively provided to the at least one driving terminals, each configured to supply the driving current to the corresponding light emitting unit via the corresponding driving terminal; a control circuit configured to control the DC/DC converter such that a lowest voltage from among voltages at the aforementioned at least one driving terminals matches a reference voltage; a thermal shutdown circuit configured to shut down the driving circuit itself when a temperature to be monitored exceeds a predetermined first threshold value; and a terminal temperature detection circuit arranged in a vicinity of an external connecting terminal to be monitored, via which the driving current flows, and configured to generate a detection signal which indicates that the temperature of the external connecting terminal to be monitored has become abnormal when the temperature to be monitored exceeds a second threshold value that is lower than the first threshold value.

With such an embodiment, by reducing the driving current or otherwise disconnecting the driving current according to the detection signal, such an arrangement is capable of preventing the temperature of the external connecting terminal from remaining in a high-temperature state. Thus, such an arrangement suppresses deterioration of solder which is welded to the external connecting terminal.

Also, the external connecting terminal to be monitored may be the driving terminal.

Also, the second threshold value may be determined according to a lowest temperature that leads to deterioration of a solder which is welded to the external connecting terminal in a process in which the driving circuit is mounted on a printed-circuit board.

Also, the first threshold value may be set to 130 degrees or more. Also, the second threshold value may be set to 100 degrees or less.

Also, the terminal temperature detection circuit may be provided to each of the at least one driving terminals.

With such an arrangement, high-temperature state detection can be performed for each driving terminal. Thus, such an arrangement is capable of providing flexible circuit protection such as protection which allows each current source to reduce its output driving current value.

Yet another embodiment of the present invention relates to a light emitting apparatus. The light emitting apparatus comprises: at least one light emitting units; a DC/DC converter configured to supply a driving voltage to each of the at least one light emitting units; and a driving circuit according to any one of the aforementioned embodiments, configured to supply a driving current to each of the at least one light emitting units, and to control the DC/DC converter.

Yet another embodiment of the present invention relates to a display apparatus. The display apparatus comprises: a liquid crystal panel; and the aforementioned light emitting apparatus with its light emitting unit configured as a backlight arranged on the back face of the liquid crystal panel.

It should be noted that any combination of the aforementioned components or any manifestation of the present invention may be mutually substituted between a method, apparatus, and so forth, which are effective as an embodiment of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
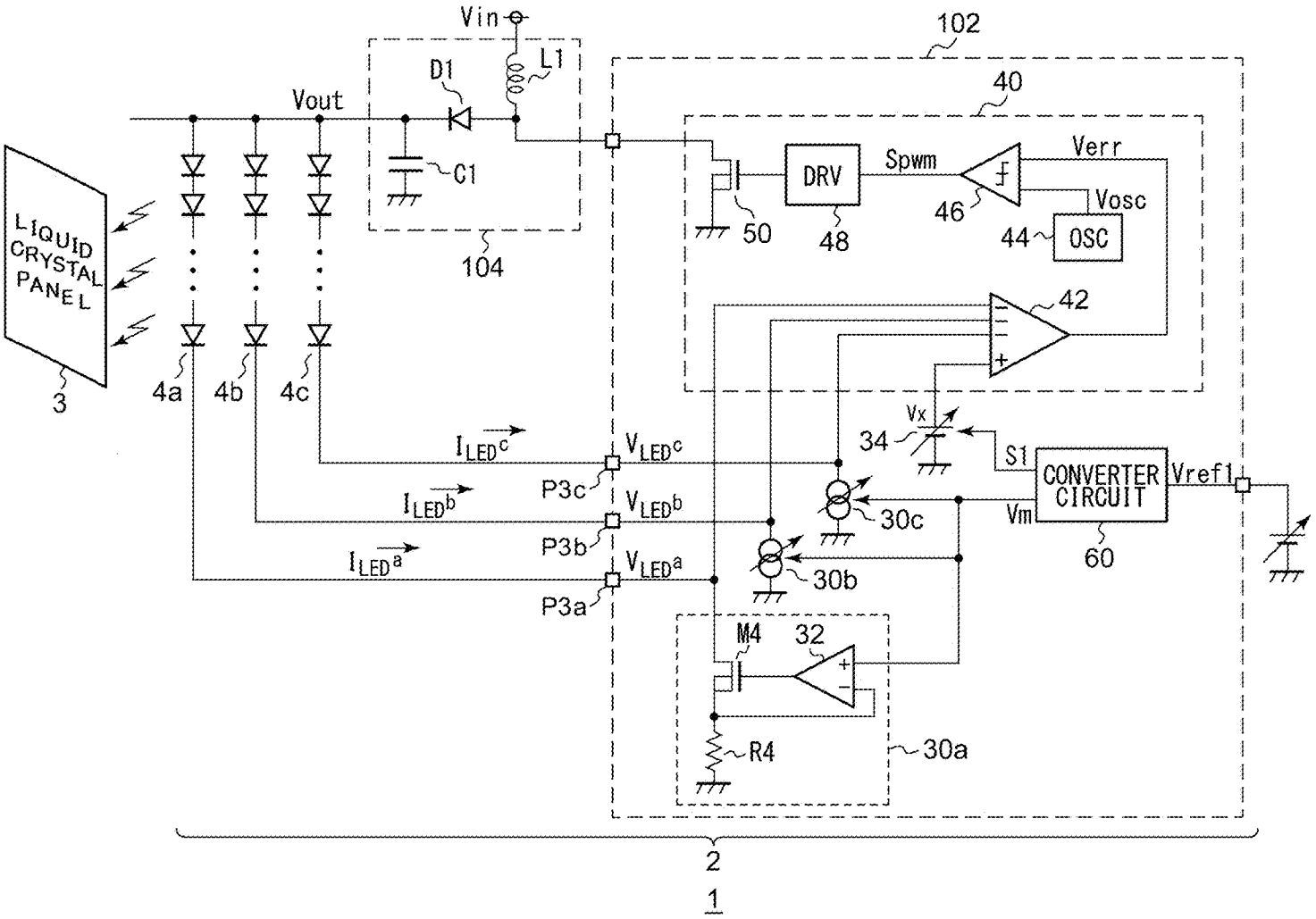
FIG. 1 is a circuit diagram which shows a display apparatus including a driving IC according to an embodiment.

Description will be made below regarding preferred embodiments according to the present invention with reference to the drawings. The same or similar components, members, and processes are denoted by the same reference numerals, and redundant description thereof will be omitted as appropriate. The embodiments have been described for exemplary purposes only, and are by no means intended to restrict the present invention. Also, it is not necessarily essential for the present invention that all the features or a combination thereof be provided as described in the embodiments.

In the present specification, the state represented by the phrase "the member A is connected to the member B" includes a state in which the member A is indirectly connected to the member B via another member that does not affect the electric connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not affect the electric connection therebetween, in addition to a state in which the member A is directly connected to the member C, or the member B is directly connected to the member C.

FIG. 1 is a circuit diagram which shows a configuration of a display apparatus 1 including a driving IC 102 according to an embodiment. The display apparatus 1 includes a light emitting apparatus 2 configured as a backlight and a liquid crystal panel 3.

The light emitting apparatus 2 includes multiple light emitting units 4*a* through 4*c*, a DC/DC converter 104, and a driving IC 102. The light emitting units 4*a* through 4*c* are each configured as a single LED or otherwise an LED string including multiple LEDs connected in series. FIG. 1 shows an arrangement including three light emitting units 4. However, the number of light emitting units may be determined as desired, as long as such an arrangement includes at least one light emitting unit. The light emitting units 4*a* through 4*c* are configured as a backlight arranged on the back face of the liquid crystal panel 3.

The DC/DC converter 104 is configured to boost an input voltage Vin, and to supply a driving voltage Vout to one terminal (first terminal) to which the light emitting units 4*a* through 4*c* are commonly connected. The DC/DC converter 104 includes an inductor L1, a diode D1, and a capacitor C1. The DC/DC converter has a typical circuit topology, and accordingly, description thereof will be omitted.

The driving IC 102 is a function IC configured to supply respective driving currents $I_{LEDa}$ through $I_{LEDc}$ to the light emitting units 4*a* through 4*c*, and to control the DC/DC converter 104 so as to adjust the driving voltage Vout. The driving IC 102 is integrated on a single semiconductor chip. Description will be made below regarding the configuration of the driving IC 102.

The driving IC 102 includes multiple driving terminals (which will be referred to as "LED terminals" hereafter) P3*a* through P3*c*, multiple current sources 30*a* through 30*c*, a reference voltage source 34, and a control circuit 40.

The LED terminals P3*a* through P3*c* are provided to the light emitting units 4*a* through 4*c*, respectively. The LED terminals P3*a* through P3*c* are each connected to the second terminal of the corresponding light emitting unit 4. The current sources 30*a* through 30*c* are provided to the LED terminals P3*a* through P3*c*, respectively. The current sources 30*a* through 30*c* are respectively configured to supply adjustable driving currents $I_{LEDa}$ through $I_{LEDc}$ to the respective light emitting units 4*a* through 4*c* via the respective LED terminals P3*a* through P3*c*.

The current sources 30*a* through 30*c* each have the same configuration. The current source 30*a* includes a transistor M4, a resistor R4, and an error amplifier 32. A second voltage Vm is input to the non-inverting input terminal of the error amplifier 32. The transistor M4 and the resistor R4 are arranged in series between the LED terminal P3*a* and the ground terminal. The voltage at a connection node that connects the transistor M4 and the resistor R4 is fed back to the inverting input terminal of the error amplifier 32. The current source 30*a* generates the driving current $I_{LEDa}$ which is proportional to the second voltage Vm, which is represented by $I_{LEDa}$=Vm/R4. The resistor R4 may be configured as a component external to the driving IC 102.

A converter circuit 60 is configured to receive a first voltage Vref1 which indicates a target value of the driving current $I_{LED}$, to generate the second voltage Vm that corresponds to the driving current $I_{LED}$, e.g., that is proportional to the driving current $I_{LED}$, and to output the second voltage Vm to the current sources 30*a* through 30*c*. The first voltage Vref1 may be supplied without change as the second voltage Vm to the current sources 30*a* through 30*c*. That is to say, the driving currents $I_{LEDa}$ through $I_{LEDc}$ are set to a current value that corresponds to the first voltage Vref1. The driving IC 102 may receive the first voltage Vref1 from an external circuit, or otherwise may generate the first voltage Vref1 by means of a built-in voltage source included within the driving IC 102 according to a control signal input from an external circuit.

Furthermore, the converter circuit 60 is configured to generate a control signal S1 that corresponds to the first voltage Vref1, in addition to the second voltage Vm that corresponds to the first voltage Vref1. The reference voltage source 34 is configured to generate a reference voltage Vx that corresponds to the control signal S1. That is to say, the reference voltage source 34 is configured to generate the reference voltage Vx that corresponds to the driving current $I_{LED}$ generated by the current sources 30*a* through 30*c*.

The control circuit 40 controls the DC/DC converter 104 such that the lowest voltage among the voltages $V_{LEDa}$ through $V_{LEDc}$ respectively output from the LED terminals P3*a* through P3*c* matches the reference voltage Vx. The control circuit 40 includes an error amplifier 42, an oscillator 44, a PWM comparator 46, a driver 48, and a switching transistor 50.

The switching transistor 50 is arranged on a path of the inductor L1 of the DC/DC converter 104. The error amplifier 42, the oscillator 44, and the PWM comparator 46 constitute a so-called pulse width modulator. The error amplifier 42 generates an error voltage Verr that corresponds to the difference between the reference voltage Vx and the lowest voltage among the voltages $V_{LEDa}$ through $V_{LEDc}$. The oscillator 44 generates a cyclic signal Vosc having a triangle waveform or sawtooth waveform. The PWM comparator 46 is configured to compare the error voltage Verr with the cyclic signal Vosc, and to generate a pulse-width modulated pulse signal Spwm. The driver 48 performs switching of the switching transistor 50 according the pulse signal Spwm. It should be noted that the configuration of the control circuit 40 is not restricted to such an arrangement shown in FIG. 1. Also, the control circuit 40 may have other configurations.

Figure 2A:
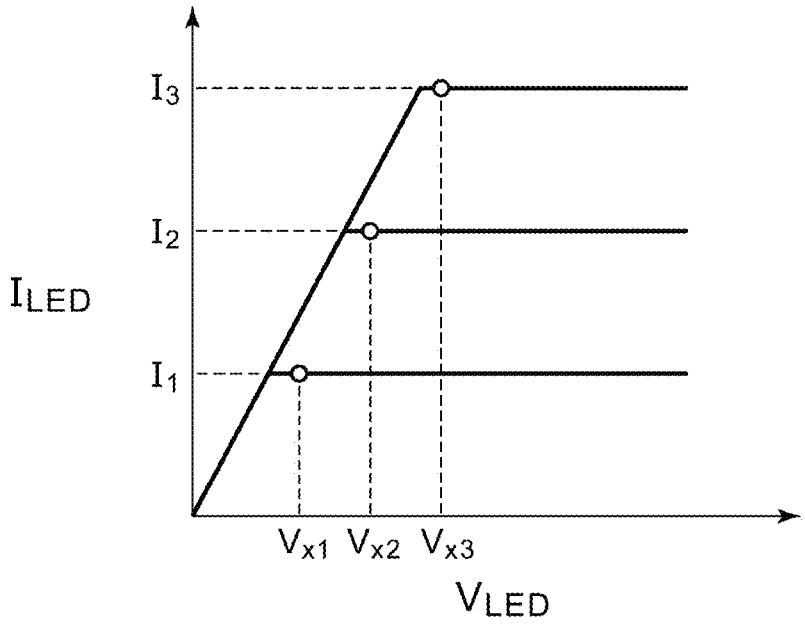
FIG. 2A is a diagram showing the relation between the voltage between the respective terminals of a current source and the driving current.
Figure 2B:
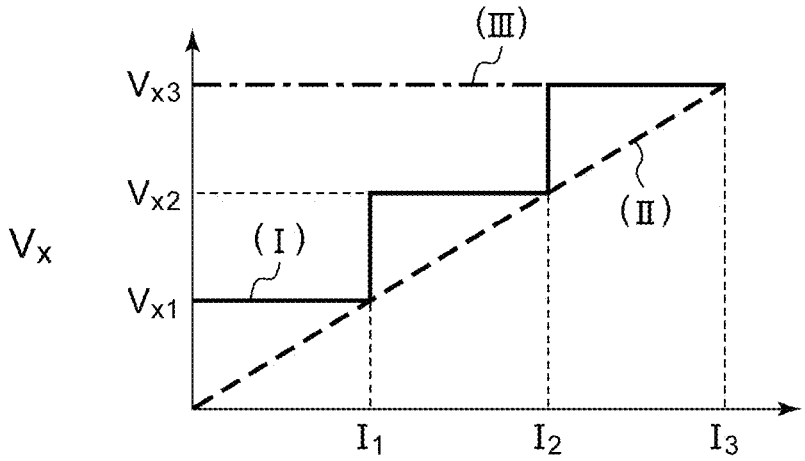
FIG. 2B is a diagram showing the relation between the driving current and the reference voltage.

The above is the configuration of the driving IC 102. Next, description will be made regarding the operation thereof. FIG. 2A is a diagram showing the relation between the voltage (LED terminal voltage) $V_{LED}$ that develops between the respective terminals of the current source 30 and the driving current $I_{LED}$. FIG. 2B is a diagram which shows the relation between the driving current $I_{LED}$ and the reference voltage Vx.

Directing attention to FIG. 2A, in order to allow the current source 30 to generate the driving current $I_{LED}$ of $I_1$ (e.g., 20 mA), there is a need to apply the LED terminal voltage $V_{LED}$ that is higher than a first operation guaranteed voltage Vx1. As the driving current $I_{LED}$ becomes higher, e.g., is raised to $I_2$ (e.g., 40 mA) and $I_3$ (e.g., 60 mA), the operation guaranteed voltages that are required to be applied to the LED terminal become higher, e.g., are raised to Vx2 and Vx3, respectively.

In a case in which the reference voltage Vx generated by the reference voltage source 34 is fixed regardless of the value of the driving current $I_{LED}$, there is a need to always set the reference voltage Vx to the voltage value Vx3 or more in order to allow the current source 30 to generate the assumed maximum driving current $I_{LED}$ (e.g., $I_3$=60 mA). The line of dashes and dots (III) shown in FIG. 2B represents a case in which the reference voltage Vx is fixed.

In principle, when the driving current $I_1$ (20 mA) is generated, a sufficient voltage to be generated between the respective terminals of the current source 30 is Vx1. However, such an arrangement operates at an operating point Vx3 that is higher than the sufficient voltage Vx1, leading to wasted power consumption.

With the driving IC 102 according to the embodiment, as indicated by the solid line (I) shown in FIG. 2B, the reference voltage source 34 is configured to generate the reference voltage Vx that is changed in a stepwise manner according to the driving current $I_{LED}$. With such an arrangement, the converter circuit 60 may generate the control signal S1 by means of a comparator configured to compare the first voltage Vref1 with the threshold voltages $Vth_1$, $Vth_2$, and $Vth_3$ that correspond to the current values $I_1$, $I_2$, and $I_3$. Thus, such an arrangement is capable of switching the reference voltage Vx in a stepwise manner according to the driving current $I_{LED}$.

Alternatively, as indicated by the broken line (II) in FIG. 2B, the reference voltage source 34 may generate the reference voltage Vx that is substantially proportional to the driving current $I_{LED}$. With such an arrangement, the converter circuit 60 may be configured as an amplifier configured to output the control signal S1 that corresponds to the first voltage Vref1.

As indicated by the solid line (I) or broken line (II) in FIG. 2B, by adjusting the reference voltage Vx according to the driving current $I_{LED}$, such an arrangement is capable of reducing wasted power consumption by the current source 30. Thus, such an arrangement is capable of driving the light emitting units 4 with high efficiency.

Figure 3:
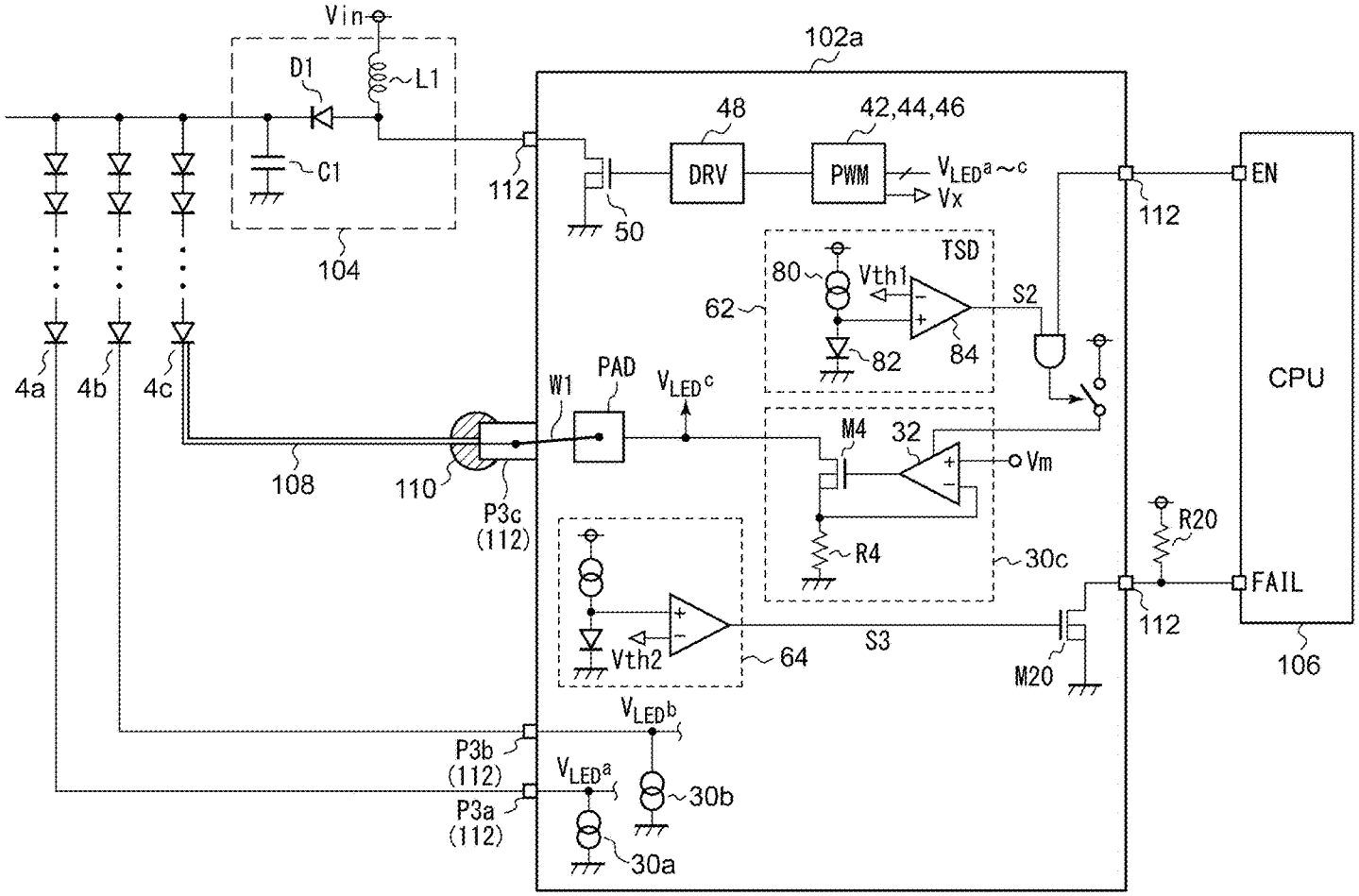
FIG. 3 is a circuit diagram which shows a configuration of a driving IC according to a second embodiment.

FIG. 3 is a circuit diagram which shows a configuration of a driving IC 102*a* according to a second embodiment. The technique according to the second embodiment may be combined with the technique described in the first embodiment. Alternatively, the technique according to the second embodiment may be employed separately as a single technique. Description will be omitted regarding the same components as those shown in FIG. 1.

A driving IC 102*a* includes external connecting terminals such as leads or otherwise backside electrodes. Each external terminal is electrically and mechanically connected to a wiring pattern 108 formed on a printed-circuit board by solder 110.

The driving IC 102*a* includes a thermal shutdown circuit 62 and a terminal temperature detection circuit 64, in addition to the configuration shown in FIG. 1. The thermal shutdown circuit 62 is configured to monitor the temperature of a chip (die) on which the driving IC 102*a* is formed, and to stop the operation of the driving IC 102*a* when the temperature to be monitored exceeds a first threshold value $T_{th1}$, thereby protecting the driving IC 102*a* from overheating. The thermal shutdown circuit 62 includes a constant current source 80, a diode 82, and a comparator 84. A constant current Ic generated by the constant current source 80 passes through the diode 82. Voltage drop Vf, which changes according to the temperature, occurs between the respective terminals of the diode 82. The comparator 84 is configured to compare the voltage drop Vf with a threshold voltage Vth1 that corresponds to a first threshold value $T_{th1}$ so as to generate a detection signal S2 which indicates whether the temperature is normal or abnormal. For example, the first threshold value $T_{th1}$ is set to a value that ensures the reliability of the driving IC 102*a*. Preferably, the first threshold value $T_{th1}$ is set to 130° C. or more, e.g., set to 150° C.

The driving IC 102*a* includes at least one terminal temperature detection circuit 64, in addition to the thermal shutdown circuit 62. The terminal temperature detection circuit 64 may be configured in the same manner as that of the thermal shutdown circuit 62.

The terminal temperature detection circuit 64 is arranged in the vicinity of an external connecting terminal 112 via which the driving current $I_{LED}$ flows. FIG. 3 shows an arrangement in which the LED terminal P3*c* is configured as an external connecting terminal 112 to be monitored. When the temperature to be monitored exceeds a second threshold value $T_{th2}$, the terminal temperature detection circuit 64 generates a detection signal S2 which indicates that the temperature of the external connecting terminal 112 to be monitored has become abnormal. The second threshold value $T_{th2}$ is set to be lower than the first threshold value $T_{th1}$.

The second threshold value $T_{th2}$ is determined according to the lowest temperature that leads to deterioration of the solder 110 which is welded to the connecting terminal 112 in the process in which the driving IC 102*a* is mounted on the printed-circuit board. Typically, deterioration of solder occurs at 90° C. or more. Thus, the second threshold value $T_{th2}$ is preferably set to be 100° C. or less. For example, the second threshold value $T_{th2}$ is preferably set to 90° C.

The driving IC 102*a* includes pads that correspond to the respective external connecting terminals. The phrase "in the vicinity of an external connecting terminal" represents a region in the vicinity of the corresponding pad PAD formed on the IC chip to which the external connecting terminal is connected by bonding wiring W1 or otherwise rewiring.

A detection signal S3 generated by the terminal temperature detection circuit 64 is output to an external CPU 106 via an open-drain interface circuit (M20, R20). At a fail terminal FAIL of the CPU 106, an electric potential occurs according to the detection signal S3. The CPU 106 generates an enable signal EN according to the electric potential at the fail terminal FAIL, and outputs the enable signal EN to the driving IC 102*a*. When the enable signal EN is asserted, the driving IC 102*a* operates normally. When the enable signal EN is negated, the current source 30 stops generation of the driving current $I_{LED}$, or otherwise reduces the driving current $I_{LED}$. In a case in which light emitting units 4 are configured to be PWM driven, such an arrangement may be configured to reduce the duty ratio of the switching operation so as to reduce the effective driving current $I_{LED}$.

The above is the configuration of the driving IC 102*a*. With the driving IC 102*a* shown in FIG. 3, when a large current is applied to the light emitting units 4*a* through 4*c*, such a large current leads to heat generation at the current sources 30*a* through 30*c*, leading to an increase in the temperature of each external connecting terminal via which the driving current $I_{LED}$ flows. Thus, by monitoring the temperature of the external connecting terminal 112 via which the driving current $I_{LED}$ flows, in addition to the monitoring by means of the thermal shutdown circuit, such an arrangement is capable of preventing the temperature of the external connecting terminal 112 from rising. This prevents deterioration of the solder 110 welded to the external connecting terminal 112, thereby providing the light emitting apparatus 2 with long life.

With the driving IC 102 shown in FIG. 1, such an arrangement requires only a low electric potential $V_{LED}$ at the LED terminal P3 to perform a light emitting operation. Accordingly, such an arrangement provides reduced heat generation at the current source 30, as compared with conventional techniques. Thus, by combining the terminal temperature detection circuit 64 shown in FIG. 3 with the driving IC 102 shown in FIG. 1, such an arrangement appropriately prevents the temperature of the connecting terminal 112 from rising.

Description has been made regarding the present invention with reference to the embodiments. The above-described embodiments have been described for exemplary purposes only, and are by no means intended to be interpreted restrictively. Rather, it can be readily conceived by those skilled in this art that various modifications may be made by making various combinations of the aforementioned components or processes, which are also encompassed in the technical scope of the present invention. Description will be made below regarding such modifications.

Description has been made with reference to FIG. 1 regarding the driving IC 102 having a configuration in which the reference voltage source 34 generates a reference voltage Vx according to the control signal S1 that corresponds to the first voltage Vref1. However, the present invention is not restricted to such an arrangement.

For example, with the driving IC 102 shown in FIG. 1, the reference voltage source 34 may be configured to receive the first voltage Vref1, instead of the control signal S1, and to generate the reference voltage Vx according to the first voltage Vref1. Also, the reference voltage source 34 may be configured to receive the second voltage Vm, and to generate the reference voltage Vx according to the second voltage Vm.

Figure 4A:
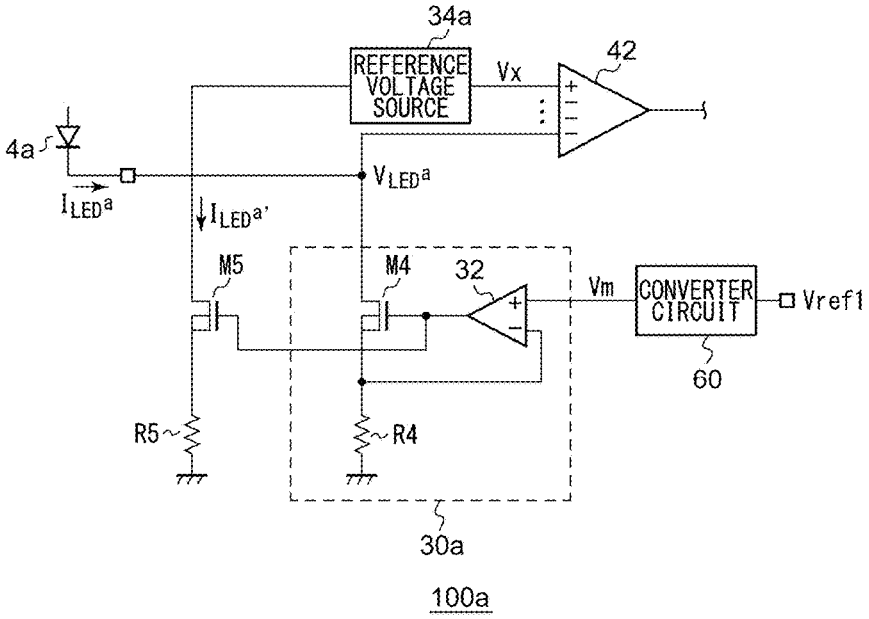
FIGS. 4A and 4B are circuit diagrams each showing a modification of the driving IC shown in FIG. 1.
Figure 4B:
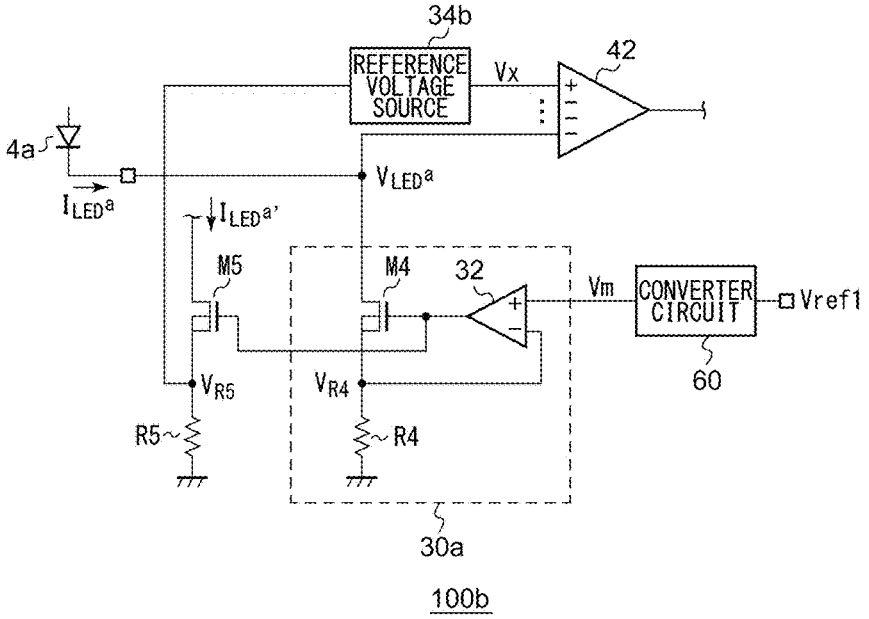

FIGS. 4A and 4B are circuit diagrams each showing a modification of the driving IC shown in FIG. 1. The same configuration as that shown in FIG. 1 is not shown.

With such modifications shown in FIGS. 4A and 4B, the reference voltage source 34 is configured to generate the reference voltage Vx that corresponds to at least one from among the driving currents $I_{LEDa}$ through $I_{LEDc}$ that respectively actually pass through the light emitting units 4*a* through 4*c*.

Specifically, with the driving IC 102*a* shown in FIG. 4A, the gate of a transistor M5 and the gate of a transistor M4 are connected together so as to form a common gate. A resistor R5 is arranged between the source of the transistor M5 and the ground terminal. A detection current $I_{LEDa}'$ passes through the transistor M5, which corresponds to, and more specifically is proportional to, the driving current $I_{LEDa}$ that passes through the transistor M4.

The reference voltage source 34*a* is configured to receive the detection current $I_{LEDa}'$, and to generate the reference voltage Vx that corresponds to the current value of the detection current $I_{LEDa}'$. The reference voltage source 34*a* may be configured to generate the reference voltage Vx that changes in a stepwise manner according to the detection current $I_{LEDa}'$ as indicated by the solid line (I) shown in FIG. 2. Also, the reference voltage source 34*a* may be configured to generate the reference voltage Vx that is substantially proportional to the detection current $I_{LEDa}'$ as indicated by the broken line (II) shown in FIG. 2.

With a driving IC 102*b* shown in FIG. 4B, at the resistor R5, a detection voltage $V_{R5}(=I_{LEDa}'\times R5)$ occurs, which is proportional to the detection current $I_{LEDa}'$. The reference voltage source 34*b* may be configured to generate the reference voltage Vx according to the voltage drop $V_{R5}$. The reference voltage source 34*a* may be configured to generate the reference voltage Vx that changes in a stepwise manner according to the voltage drop $V_{R5}$. Also, the reference voltage source 34*a* may be configured to generate the reference voltage Vx that is substantially proportional to the voltage drop $V_{R5}$.

It should be noted that, at the resistor R4, a voltage drop $V_{R4}(=I_{LEDa}\times R4)$ occurs, which is proportional to the driving current $I_{LEDa}$. Thus, the reference voltage source 34 may be configured to generate the reference voltage Vx according to the voltage drop $V_{R4}$. With such an arrangement, the transistor M5 and the resistor R5 may be omitted.

Description has been made in the embodiment regarding the driving IC 102 configured to drive the light emitting units 4 of the display apparatus 1. However, the application of the present invention is not restricted to such an arrangement. For example, the present invention can be applied to an illumination apparatus (light emitting apparatus) employing LEDs.

Description has been made with reference to FIG. 3 regarding an arrangement including a single terminal temperature detection circuit 64. Also, such a terminal temperature detection circuit 64 may be provided to each of the multiple LED terminals P3*a* through P3*c*. Such an arrangement allows the high-temperature state to be detected independently for each of the LED terminals P3*a* through P3*c*. Thus, such an arrangement is capable of providing flexible circuit protection such as protection which allows each of the current sources 30*a* through 30*c* to reduce the value of its output driving current $I_{LED}$.

Description has been made with reference to FIG. 3 regarding an arrangement in which the terminal temperature detection circuit 64 is arranged in the vicinity of the LED terminal P3. However, the present invention is not restricted to such an arrangement. In a case in which the position of the resistor R4 is changed from being an internal component of the current source 30 to being an external component, the terminal temperature detection circuit 64 may be arranged in the vicinity of an external connection terminal to which the resistor R4 is connected, instead of the LED terminal P3*c*.

Description has been made in the embodiment regarding an arrangement in which the detection signal S3 is output to the CPU 106, and circuit protection for the driving IC 102*a* is performed by means of the CPU 106. However, the present invention is not restricted to such an arrangement. Also, the driving IC 102*a* may be configured to itself perform circuit protection for the driving IC 102*a*.

Description has been made regarding the present invention with reference to the embodiments using specific terms. However, the above-described embodiments show only the mechanisms and applications of the present invention for exemplary purposes only, and are by no means intended to be interpreted restrictively. Rather, various modifications and various changes in the layout can be made without departing from the spirit and scope of the present invention defined in appended claims.

The invention claimed is:

1. A driving circuit for use with a DC/DC converter and for use with a plurality of light emitting units, the DC/DC converter being structured to generate a driving voltage supplied to anodes of the plurality of light emitting units which are coupled together, the driving circuit comprising: a plurality of driving terminals respectively provided to the plurality of light emitting units, each coupled to a cathode of the corresponding light emitting unit; a setting terminal coupled to receive a first variable signal indicative of a target value of the driving current; a converter circuit structured to receive the first variable signal and to generate a first control signal and a second control signal according to the first variable signal; a plurality of current sources respectively provided to the plurality of driving terminals, each provided between the corresponding driving terminal and a ground, and structured to adjust the driving current through the respective light emitting unit according to the first control signal from the receiving circuit, a voltage source structured to generate a second variable signal according to the second control signal; a control circuit configured to control the DC/DC converter according to the second variable signal; wherein the control circuit controls the DC/DC converter such that a lowest voltage from among voltages at the plurality of driving terminals matches the second variable signal; wherein the control circuit comprises: a switching transistor coupled to the DC/DC converter and structured to control an operation of the DC/DC converter; an error amplifier structured to amplify a difference between a lowest voltage from among terminal voltages at the plurality of driving terminals and the second variable signal so as to generate an error signal; a pulse width modulator structured to generate a pulse signal based on the error signal; and a driver structured to control on/off state of the switching transistor based on the pulse signal.

2. The driving circuit according to claim 1, wherein the driving voltage and a reference voltage change substantially linearly with the first variable signal.

3. A light emitting apparatus comprising:

a plurality of light emitting units;

a DC/DC converter structured to supply a driving voltage to the plurality of light emitting units respectively; and the driving circuit according to claim 1, structured to control driving currents flowing through the plurality of light emitting units and to control the driving voltage supplied to the plurality of light emitting units through the DC/DC converter.

4. A display apparatus comprising:

a liquid crystal panel; and the light emitting apparatus according to claim 3, having the plurality of light emitting units arranged on the back face of the liquid crystal panel.

5. The driving circuit according to claim 3, wherein the pulse width modulator comprises: an oscillator structured to generate a cyclic signal having a triangle waveform or sawtooth waveform; and a PWM comparator structured to compare the error signal with the cyclic signal, and to generate the pulse signal based on the comparison result.

6. The driving circuit according to claim 1, wherein the driving circuit is integrated on a single semiconductor chip.

7. A driving circuit for use with a DC/DC converter and for use with a plurality of light emitting units, the DC/DC converter being structured to generate a driving voltage supplied to anodes of the plurality of light emitting units which are coupled together, the driving circuit comprising: a plurality of driving terminals respectively provided to the plurality of light emitting units, each coupled to a cathode of the corresponding light emitting unit; a converter circuit structured to receive a first signal indicative of a target value of the driving current and to generate a first control signal and a second control signal according to the first signal; a plurality of current sources respectively provided to the plurality of driving terminals, each provided between the corresponding driving terminal and a ground, and structured to adjust the driving current through the respective light emitting unit according to the first control signal from the receiving circuit, a voltage source structured to generate a second signal according to the second control signal; a control circuit configured to control the DC/DC converter according to the second variable signal; wherein the control circuit controls the DC/DC converter such that a lowest voltage from among voltages at the plurality of driving terminals matches the second signal; wherein the control circuit comprises: a switching transistor coupled to the DC/DC converter and structured to control an operation of the DC/DC converter; an error amplifier structured to amplify a difference between a lowest voltage from among terminal voltages at the plurality of driving terminals and the second signal so as to generate an error signal; a pulse width modulator structured to generate a pulse signal based on the error signal; and a driver structured to control on/off state of the switching transistor based on the pulse signal.

8. The driving circuit according to claim 7, wherein the driving voltage and a reference voltage change substantially linearly with the first signal.

9. A light emitting apparatus comprising:

a plurality of light emitting units;

a DC/DC converter structured to supply a driving voltage to the plurality of light emitting units respectively; and the driving circuit according to claim 7, structured to control driving currents flowing through the plurality of light emitting units and to control the driving voltage supplied to the plurality of light emitting units through the DC/DC converter.

10. A display apparatus comprising:

a liquid crystal panel; and the light emitting apparatus according to claim 9, having the plurality of light emitting units arranged on the back face of the liquid crystal panel.

11. The driving circuit according to claim 9, wherein the pulse width modulator comprises: an oscillator structured to generate a cyclic signal having a triangle waveform or sawtooth waveform; and a PWM comparator structured to compare the error signal with the cyclic signal, and to generate the pulse signal based on the comparison result.

12. The driving circuit according to claim 7, wherein the driving circuit is integrated on a single semiconductor chip.

* * * * *